United States Patent [19]

Sedlacek et al.

[11] 4,114,629

[45] Sep. 19, 1978

[54] CIGARETTE ROLLING PAPER WITH INTEGRAL POUCH

[76] Inventors: Bruce Sedlacek, 4364 Wagman, Oak Forest, Ill. 60452; Gus Stevens, Jr., 5707 S. Monitor, Chicago, Ill. 60638

[21] Appl. No.: 687,047

[22] Filed: May 17, 1976

[51] Int. Cl.[2] ..... A24D 1/02

[52] U.S. Cl. ..... 131/15 R

[58] Field of Search ..... 131/15 R, 15 B; 206/260, 136, 496; 229/68, 72, 75, 77, 78 A, 80, 81

[56] References Cited

U.S. PATENT DOCUMENTS

| | | | |
|---|---|---|---|
| 963,894 | 7/1910 | Hoar | 229/75 |
| 1,363,989 | 12/1920 | Morley | 131/15 R |
| 3,861,403 | 1/1975 | Vinals et al. | 131/15 R |

FOREIGN PATENT DOCUMENTS

| | | | |
|---|---|---|---|
| 510,067 | 7/1938 | United Kingdom | 131/15 B |

*Primary Examiner*—Robert W. Michell
*Assistant Examiner*—V. Miller

[57] ABSTRACT

A cigarette rolling paper is provided with an integral pouch on one portion of the paper for receiving tobacco and for retaining and holding the tobacco therein while the rolling paper is rolled in a substantially cylindrical shape around the pouch to form a cigarette. The cigarette rolling paper has a single fold defining a bottom flap and an overlapping flap superposed upon an underlying area of part of the bottom flap. Each end edge of the overlapping flap is secured to an underlying area of the bottom flap along the end edges of the bottom flap leaving a side edge of the overlapping flap free of the bottom flap to thus form a pouch. The rolling paper is perforated inwardly of, and parallel to, each end edge for providing a tear strip at each end of the cigarette which can be torn away to expose the tobacco in the pouch and permit smoking of the cigarette.

10 Claims, 12 Drawing Figures

CIGARETTE ROLLING PAPER WITH INTEGRAL POUCH

BACKGROUND OF THE INVENTION

This invention relates to cigarette rolling papers, and more particularly to an improvement in the construction of a cigarette rolling paper wherein an integral tobacco pouch is provided thereon.

Conventionally, cigarette rolling papers are made from thin, tissue-like paper having a quadrilateral shape with sides of between 1 and 4 inches in length, and usually between 2.5 to 3.5 inches in length.

When making or "hand rolling" a cigarette using a quadrilaterally shaped cigarette rolling paper, the paper is folded, bent, or held in somewhat of a V-shape or U-shape with one of the sides of the "V" or "U" being longer than the other. An amount of smoking material, such as tobacco or the like, is distributed substantially over the entire length of that rolling paper in the bottom of the "V" or "U" formed by the rolling paper. The longer portion of the rolling paper, being free of any of the smoking material, is then bent or rolled over the portion of the rolling paper covered with the tobacco and is rolled over upon itself to form a substantially cylindrical shape. The longer end of the rolling paper is wrapped around as far as possible and overlaps an underlying layer to form a part of the wall of the cylinder.

The rolling process, when performed by one person, requires a keen eye and a steady hand, since the rolling paper is not very large compared to a human hand and since the particles of smoking material tend to roll, or slide, off of the small rolling paper. The particles of smoking material tend to fall off either end, or off of the sides of the cigarette rolling paper as it is being rolled. Thus, when a smoking material, such as tobacco or the like, is placed on the cigarette rolling paper, the cigarette rolling paper must be held substantially horizontally and any tipping in one direction or the other must be avoided as the smoking substance is apt to spill off of the rolling paper.

SUMMARY OF THE INVENTION

In accordance with this invention a cigarette rolling paper is provided with an integral pouch for receiving and containing a smoking substance, such as tobacco or the like. A pouch, having three closed sides and one open side, is oriented on a cigarette rolling paper such that the length of the pouch is substantially equal to the length of the rolling paper, (i.e., the length of the finished cigarette) and so that a pouch opening is adjacent, or disposed over, the underlying portion of the cigarette rolling paper.

In the preferred embodiment, the cigarette rolling paper is square, or rectangular, in shape. Two opposed side edges of the square or rectangular shaped rolling paper are parallel to the longitudinal axis of the finished cigarette. The other two opposed end edges of the cigarette paper (perpendicular to the longitudinal axis of the cigarette) become the front and back end of the finished rolled cigarette.

In the preferred embodiment, the cigarette rolling paper has a single fold which defines a bottom flap and an overlapping flap superposed upon an underlying area of a part of the bottom flap. A remaining portion of the bottom flap is not superposed by the overlapping flap and extends beyond the overlapping flap. The overlapping flap has two side edges, one being defined by the fold and the other being defined by a side edge of the cigarette rolling paper per se. The overlapping flap also has two end edges which, in the preferred embodiment, are in registry with the underlying edges of the underlying area of the bottom flap. The ends of the overlapping flap are secured, along the end edges, to, and along, the end of the edges of the underlying area of the bottom flap. The overlapping flap is otherwise free of the underlying area of the bottom flap and the pouch is thus formed by the overlapping flap and the bottom flap between the secured end edges of the underlying area of the bottom flap. The pouch is open at the one side formed by a side edge of the overlapping flap.

Apertures or punched holes are disposed along the end edges of the overlapping flap and along the end edges of the remaining portion of the bottom flap to provide a tear strip at each end of the rolling paper whereby, when the tear strips are torn away, the ends of the pouch are no longer secured together and access is had to the pouch from either end. Thus, when the remaining portion of the bottom flap is rolled over upon the pouch containing a smoking substance and further wrapped around upon itself to form a cylindrical cigarette, the tear strips can be torn away whereby air flow can be drawn through one end of the pouch and out the other end of the pouch in the usual smoking manner.

Numerous other advantages and features of the present invention will become readily apparent from the following detailed description of the invention and of one embodiment thereof, from the claims, and from the accompanying drawings in which each and every detail shown is fully and completely disclosed as a part of this specification.

DESCRIPTION OF THE PREFERRED EMBODIMENT

Figure 1:
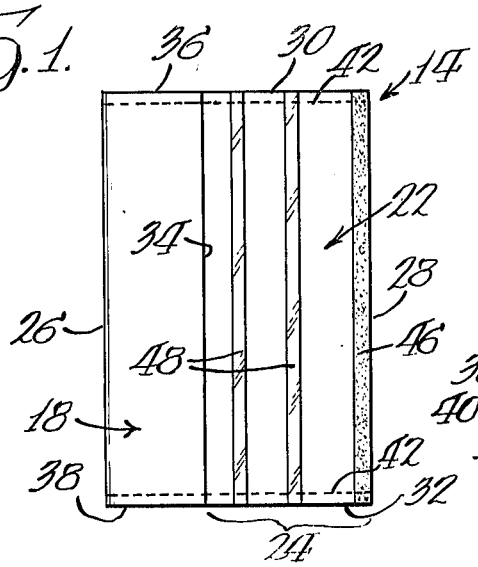
FIG. 1 is a plan view of the cigarette rolling paper with an integral pouch in accordance with the present invention.

While this invention is susceptible of embodiment in many different forms there is shown in the drawings and will herein be described in detail a preferred embodiment of the invention and modifications thereof, with the understanding that the present disclosure is to be considered as an exemplification of the principles of the invention and is not intended to limit the invention to the embodiments illustrated. The scope of the invention will be pointed out in the appended claims.

Referring now to FIG. 1, an embodiment of a cigarette rolling paper with an integral pouch in accordance with the present invention is shown in plan view and is generally indicated by reference numeral 14. The various embodiments of the present invention are formed of conventional cigarette rolling paper of the appropriate thickness and composition as is well known in the art.

Figure 2:
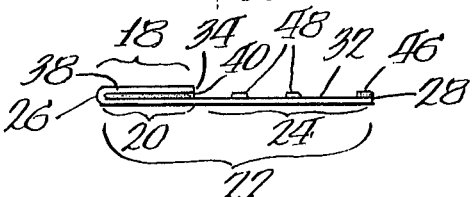
FIG. 2 is an end view of the cigarette rolling paper of FIG. 1.

Referring to FIG. 2, it is seen that a substantially rectangular sheet of cigarette paper has a single fold creating an overlapping flap 18 superposed upon an underlying area 20 of a bottom flap 22. A portion 24 of the bottom flap 22 extends beyond the overlapping flap 18 and functions as a pouch closure means as will hereinafter be described.

Preferably, the bottom flap 22 has two parallel side edges, 26 and 28. Side edge 26 is formed by the fold between the overlapping flap 18 and the bottom flap 22. The side edge 28 is one of the side edges of the cigarette rolling paper per se. The bottom flap 22 also has two opposed and parallel end edges 30 and 32.

Figure 3:
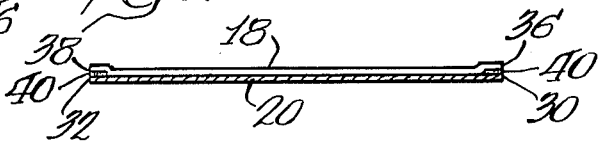
FIG. 3 is a cross-sectional view taken along plane 3—3 of FIG. 2.

Preferably, the overlapping flap 18 has two opposed side edges, 26 and 34, where side edge 26 is formed by the fold between the overlapping flap 18 and the bottom flap 22 and side edge 34 is one of the side edges of the cigarette rolling paper per se. In the preferred embodiment, the overlapping flap 18 also has two opposed, parallel end edges 36 and 38 in registry with the end edges 30 and 32, respectively, of the bottom flap 22. The overlapping flap 18 is secured to the underlying area 20 of the bottom flap along the pairs of registered end edges, 38/32 and 36/30, by suitable adhesive strips 40 (FIG. 3). The edges could be secured by other appropriate means, such as interlocking paper perforations, glue, stitching, etc. Side edge 34 is left free of, and unattached to, any part of bottom flap 22.

A pouch is thus formed which has (1) two ends formed by the secured pairs of end edges, 38/32 and 36/30; (2) a bottom formed by folded side edge 26; (3) a front wall formed by overlapping flap 18; (4) a back wall formed by underlying area 20; and (5) a pouch opening at side edge 34 between the overlapping flap 18 and the underlying area 20.

Preferably, a single sheet of substantially rectangular or square shaped cigarette rolling paper is used to form the above described, once-folded, structure. Typically, the length of the cigarette paper (i.e., the length of the finished, hand rolled cigarette), measured along side edge 28, 26 or 34, is about 3.0 inches. The width of the cigarette paper, in the unfolded state, is typically about 2.5 inches for the so-called conventional one and a half width paper, and is about 3.3 inches for the so-called conventional double width paper.

Preferably, the overlapping flap 18 overlaps the bottom flap 22 from between 0.5 inch to 1.0 inch, but most preferably 0.75 inch. The amount of overlap can be also characterized by the ratio of the width of the overlapping flap 18 to the total width of the paper: for double width paper the ratio is preferably between 5:33 and 10:33 and for one and a half width paper the ratio is preferably between 1:5 and 2:5.

It is desirable to provide openings on each end of the finished, rolled cigarette to permit air to be drawn through the lighted end and into the mouth of the smoker at the other end. As is illustrated in FIG. 1, the rolling paper is perforated inwardly of, and parallel to, each end edge of the rolling paper with perforations 42. The perforations 42 provide a tear strip at each end of the cigarette which can be torn away to expose the smoking material in the pouch and permit smoking of the cigarette. The perforations 42 extend completely across each end of the overlapping flap 18 forming the pouch front wall between side edge 26 and side edge 34. The perforations also extend completely across underlying area 20 of bottom flap 22. Further, in the preferred embodiment, the perforations continue across the portion 24 of the bottom flap 22 which extends beyond the overlapping flap 18.

Figure 6:
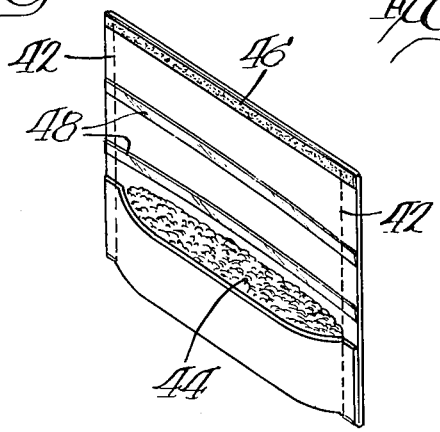
FIG. 6 is a perspective view of the embodiment of FIGS. 1–3 filled with smoking material.
Figure 7:
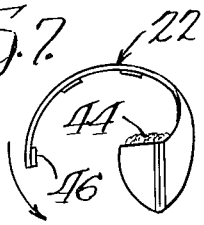
FIG. 7 is an end view of a cigarette rolling paper of FIG. 6 showing the paper being rolled to form a cigarette.
Figure 8:
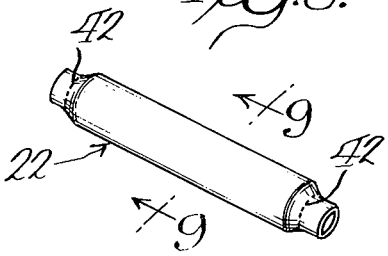
FIG. 8 is a perspective view of a hand rolled cigarette made with the cigarette paper of this invention.
Figure 9:
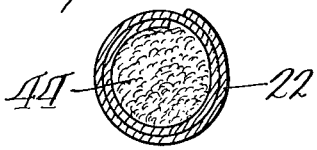
FIG. 9 is an enlarged cross-sectional view taken along plane 9—9 of FIG. 8.

When tobacco 44 is placed in the pouch as illustrated in FIG. 6, the portion 24 of the bottom flap 22 extending beyond the overlapping flap 18 can be partially rolled around and over the tobacco 44 as illustrated in FIG. 7 to function as a pouch closure means. At this point, the ends of the rolling paper could be torn away at perforation 42 before the rolling process is completed. However, the ends of the rolling paper need not be torn away at the perforations 42 until the rolling paper has been completely rolled in a cylindrical manner to form the finished cigarette as shown in FIGS. 8 and 9. At this point, the end edges of the rolling paper could be torn away on each end of the cigarette at the perforation 42. Since the end edges of the overlapping flap 18 are secured to the end edges of the underlying area 20 of the bottom flap 22, it is understood that the perforations 42 are spaced inwardly of the adhesive strip 40.

After forming the rolled cylindrical shape with the rolling paper 14, the outer layer of the rolling paper 14 is conventionally secured to the next underlying layer of the rolling paper 14 with an adhesive substance of some sort. Conventionally, this adhesive substance takes the form of a moisturizable gum strip or glue strip 46 as illustrated in FIGS. 1, 2, 6, and 7. This strip is generally at or near side edge 28 of the bottom flap 22 and conventionally runs the entire length of the cigarette paper 14. The width of the glue strip 46 is nominally 0.25 inches, although a narrower or wider strip would also be acceptable.

A flavored material may be coated on all, or a part of, the cigarette rolling paper 14. As illustrated in FIGS. 1, 2, and 6, flavored material is coated on the bottom flap 22 in flavor strips 48 which are disposed substantially perpendicular to the side edges 32 and 30 and run the entire length of the rolling paper 14. The flavor strips 48 can impart flavor to the paper and cigarette smoke such as mint, fruit flavors, or other tangy, spicy, sweet, sour, salted, and bitter flavors. Instead of a strip form per se, the flavor may be coated on the rolling paper 14 in individual designs, such as outlines of animals, fruit, or in the form of words or logo symbols.

Figure 4:
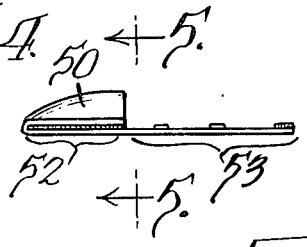
FIG. 4 is an end view of another embodiment of a cigarette rolling paper in accordance with the present invention.
Figure 5:
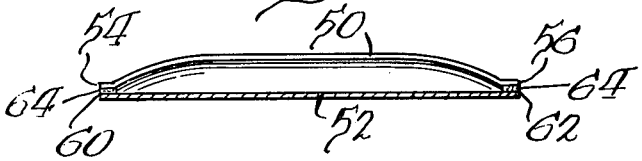
FIG. 5 is a cross-sectional view taken along plane 5—5 of FIG. 4.
Figure 5A:
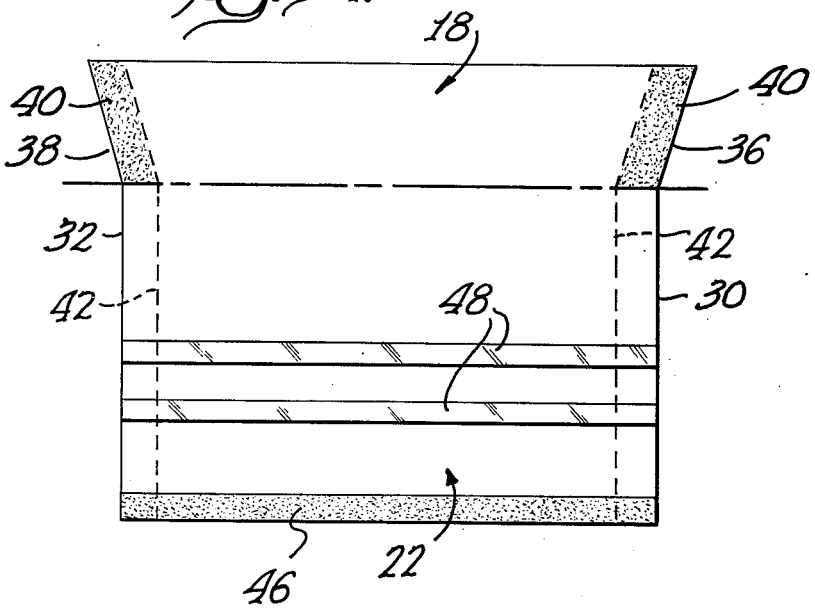
FIG. 5A is a plan view of the cigarette rolling paper with an overlapped flap having end edges angled outwardly.

A modification of the preferred embodiment of this invention is shown in FIGS. 4 and 5 wherein a pouch is provided which has a specific unfilled volume to more easily enable a person to fill the pouch with smoking substance. The modification shown in FIGS. 4 and 5 is formed in substantially the same manner as the embodiment shown in FIGS. 1 through 3 with the exception that the overlapping flap, here designated 50, has a length slightly greater than the length of the underlying portion, here designated 52. This can be effected by providing an overlapping flap 50 which has end edges 54 and 56 which each angle outward, when the rolling paper is in the flat, unfolded condition as illustrated in FIG. 5A. When the overlapping flap 50 is folded over the underlying portion 52, the outwardly angled edges 54 and 56 are pushed inwardly and aligned in registry with the underlying edges 60 and 62 respectively, of the underlying portion 52. This causes the excess material in the overlapping flap 50 to bulge outwardly, or buckle outwardly, thereby providing a preformed volume for accommodating smoking materials. The two end edges 54 and 56 of overlapping flap 50 are each secured to the respective end edges 60 and 62 of the underlying portion 52 with adhesive strips 64.

Figure 10:
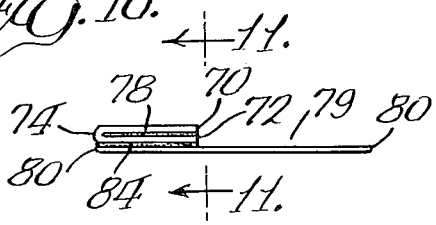
FIG. 10 is an end view of another embodiment of a cigarette rolling paper with integral pouch in accordance with the present invention.
Figure 11:
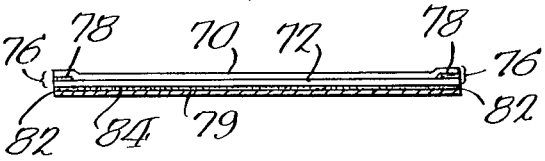
FIG. 11 is a cross-sectional view taken along plane 11—11 of FIG. 10.

Another modification of the present invention is shown in FIGS. 10 and 11 wherein a separate pouch is provided from a separate sheet of cigarette paper and attached to an underlying sheet of cigarette paper. Specifically, with reference to FIG. 10, a substantially rectangular sheet is folded over upon itself to form two pouch walls, front wall 70 and back wall 72. The pouch has a bottom edge 74 formed at the fold line and closed end edges 76 formed at each end of the pouch by securing portions of the front wall 70 and the back wall 72 along the end edges 76 with adhesive 78. The pouch is disposed over an underlying, substantially rectangular-shaped cigarette paper sheet 79 which has two side edges 80 and two end edges 82. The back wall 72 of the pouch is secured to the rectangular sheet 79 with adhesive 84. The separate pouch can be formed with a specific pre-filled volume in a manner analogous to that described above for the modified embodiment illustrated in FIGS. 4 and 5. For example, front wall 70 can be provided with its end edges angling outward to thus provide more cigarette paper in the front wall 70 which will cause it to buckle outwardly when the edges of the front wall 70 are aligned with the underlying edges of the back wall 72. Of course, appropriate perforated tear strips (not shown) can be provided on each end of the cigarette rolling paper and pouch so as to permit the ends of a rolled cigarette to be torn away to expose the tobacco therein. A glue strip and flavoring strips can be added as desired.

The separately formed pouch illustrated in FIGS. 10 and 11 need not be in registry or alignment with any one side edge 80 of the rectangular sheet 79 and the end edges 76 of the pouch need not necessarily be in registry with the end edges 82 of the underlying rectangular sheet 79. Instead, the separately formed pouch can be secured to rectangular sheet 79 at a skewed angle, offset, or displaced inwardly from either the end or side edges of the rectangular sheet 79. Further, if added stiffness or strength is required, or if multiple pouches are desired, multiple folds can be employed in a separate piece of cigarette paper to achieve the appropriate construction. Further, the separate pouch illustrated in FIGS. 10 and 11 need not be rectangular in shape but can be of any quadrilateral shape, though extreme variations from the rectangular shape could produce unusually shaped cigarettes (e.g., conical).

The tear strip provided by perforations 42 as illustrated in FIGS. 1, 6, and 8, though providing an easy method for opening the ends of the finished, rolled cigarette to permit smoking, are not necessarily required. It would be possible, though less desirable, to provide the cigarette rolling paper with a pouch and without the perforations 42. This would require the user to tear away each end of the finished, rolled cigarette by exerting more force than if the apertures 42 were present. The resulting "open" ends of the cigarette would be somewhat irregular as compared to the ends of a cigarette in which perforations 42 are employed. However, such irregularity would not hinder the smoking process.

It is seen that the present invention provides a unique method for receiving, containing, and retaining a smoking substance in a cigarette rolling paper. The novel pouch construction of this invention prevents particles of smoking material from rolling, or sliding off of, the small rolling paper and thus conserves smoking material. Further, the retention capability afforded by the pouch makes the process of rolling a cigarette faster and easier.

It will be apparent that the cigarette rolling paper with integral pouch of this invention provides a number of advantages. Although but a few of the embodiments have been illustrated, those skilled in the art will appreciate that the closure and the method of using it may take a variety of forms. Accordingly, we intend to be limited only insofar as the appended claims shall require.

We claim:

1. A cigarette rolling paper with an integral pouch comprising:

a thin, substantially rectangular sheet of cigarette paper having a single fold defining a bottom flap and an overlapping flap superposed upon an underlying area of a part of said bottom flap, said bottom flap and said overlapping flap each having two opposed side edges and two opposed end edges in registry with one another, said fold defining one of said side edges of each said flap, said end edges of said overlapping flap being adhesively secured to said end edges of said underlying area of said bottom flap to form a pouch, one of said side edges of said overlapping flap being free from said underlying area of said bottom flap between said end edges, whereby said pouch is open at one side edge thereof, the portion of said bottom flap extending beyond the open side edge of said pouch defining a closure means for retaining a smoking substance within said pouch when said portion of said bottom flap is wrapped in a substantially cylindrical shape around said pouch to form a cigarette, said pouch having means for being opened at each end edge to provide communication with the interior of said pouch when said portion of said bottom flap has been wrapped in a substantially cylindrical shape around said pouch, said pouch opening means including an array of perforations in said overlapping flap and in said underlying array of said bottom flap, said array of perforations being disposed inwardly of, and substantially parallel to, said end edges of said overlapping flap.

2. The cigarette rolling paper in accordance with claim 20, in which said pouch opening means further comprises additional perforations on said portion of said bottom flap extending beyond the open side edge of said pouch, said additional perforations being disposed inwardly of, and substantially parallel to, said end edges of said bottom flap to form a continuation of said array of said perforations in said bottom flap.

3. The cigarette rolling paper in accordance with claim 1, in which said overlapping flap is superposed upon said underlying area for about ¾ inch and the size of said cigarette paper is at least one of a single width paper, double width paper, and one-and-one-half width paper.

4. A cigarette rolling paper with a pouch comprising:

a thin, substantially rectangular sheet of cigarette paper and a separate pouch, said rectangular sheet having two sheet side edges and two sheet end edges, said pouch having two walls defining a pouch opening therebetween, a pouch bottom edge, and two pouch end edges, said pouch being superposed upon said sheet, a portion of said rectangular sheet extending beyond the pouch opening and defining a closure means for retaining a smoking substance within said pouch when said portion of said rectangular sheet is wrapped in a substantially cylindrical shape around said pouch to form a cigarette.

5. A cigarette rolling paper with a pouch comprising:

a thin, substantially rectangular sheet of cigarette paper and a separate pouch, said rectangular sheet having two sheet side edges and two sheet end edges, said pouch having two walls defining a pouch opening therebetween, a pouch bottom edge, and two pouch end edges in registry with said two sheet end edges, said pouch being superposed upon said sheet with said pouch bottom edge aligned with, and extending along, one of said sheet side edges, a portion of said rectangular sheet extending beyond the pouch opening and defining a closure means for retaining a smoking substance within said pouch when said portion of said rectangular sheet is wrapped in a substantially cylindrical shape around said pouch to form a cigarette.

6. The cigarette rolling paper in accordance with claim 5, in which said pouch has means for being opened at each of said pouch end edges to provide communication with the interior of said pouch when said portion of said rectangular sheet has been wrapped in a substantially cylindrical shape around said pouch.

7. The cigarette rolling paper in accordance with claim 6, in which said opening means is an array of perforations on said pouch disposed inwardly of, and substantially parallel to said pouch end edges.

8. The cigarette rolling paper in accordance with claim 7, in which said opening means further comprises additional perforations on said portion of said rectangular sheet extending beyond the pouch opening, said additional perforations being disposed inwardly of, and substantially parallel to, said sheet end edges to form a continuation of said array of said perforations on said pouch.

9. A cigarette rolling paper for forming a cigarette with an integral tobacco pouch defined by a bottom flap and an overlapping flap in superposition upon an underlying area of a part of said bottom flap and secured thereto, said paper comprising:

a thin, substantially rectangular sheet of cigarette paper having two opposed side edges and two opposed end edges and adapted to be bent over upon itself along a line substantially parallel to one of said side edges;

a strip of adhesive means alongside a portion of the length of each end edge for securing the end edges of the sheet forming the overlapping flap to the end edges of the sheet forming the underlying bottom flap when the sheet is bent over upon itself; and an array of at least one, substantially straight line of perforations in said sheet adjacent each said end edge, each line of perforations being spaced inwardly of, and substantially parallel to, said strip of adhesive means alongside one of said end edges and extending across said sheet between said two opposed side edges.

10. A cigarette rolling paper with an integral pouch comprising:

a thin, substantially rectangular sheet of cigarette paper having a single fold defining a bottom flap and an overlapping flap superposed upon an underlying area of a part of said bottom flap, said bottom flap and said overlapping flap each having two opposed side edges and two opposed end edges in registry with one another, said fold defining one of said side edges of each said flap, said end edges of said overlapping flap being secured to said end edges of said underlying area of said bottom flap to form a pouch, one of said side edges of said overlapping flap being free from said underlying area of said bottom flap between said end edges, whereby said pouch is open at one side edge thereof, the portion of said bottom flap extending beyond the open side edge of said pouch defining a closure means for retaining a smoking substance within said pouch when said portion of said bottom flap is wrapped in a substantially cylindrical shape around said pouch to form a cigarette, said pouch having means for being opened at each end edge to provide communication with the interior of said pouch when said portion of said bottom flap has been wrapped in a substantially cylindrical shape around said pouch, said pouch opening means including an array of perforations in said overlapping flap and in said underlying area of said bottom flap, said array of perforations being disposed inwardly of, and substantially parallel to, said end edges of said overlapping flap.

* * * * *